United States Patent [19]

Gartner

[11] Patent Number: 4,541,200

[45] Date of Patent: Sep. 17, 1985

[54] SWING-TILT FITTING FOR WINDOW OR DOORS

[75] Inventor: Fritz Gartner, Gundelfingen, Fed. Rep. of Germany

[73] Assignee: Josef Gartner & Co., Donau, Fed. Rep. of Germany

[21] Appl. No.: 504,146

[22] Filed: Jun. 14, 1983

[30] Foreign Application Priority Data

Jun. 16, 1982 [DE] Fed. Rep. of Germany ..... 3222678

[51] Int. Cl.[4] ..... E05D 15/52

[52] U.S. Cl. ..... 49/192

[58] Field of Search ..... 49/192, 193, 394

[56] References Cited

U.S. PATENT DOCUMENTS

| | | | |
|---|---|---|---|
| 3,911,621 | 10/1975 | McHeffey | 49/192 |
| 4,074,462 | 2/1978 | McHeffey | 49/192 |
| 4,339,892 | 7/1982 | Ulbricht et al. | 49/192 |

FOREIGN PATENT DOCUMENTS

| | | |
|---|---|---|
| 1257036 | 12/1967 | Fed. Rep. of Germany . |
| 2451556 | 5/1976 | Fed. Rep. of Germany . |
| 2750073 | 5/1977 | Fed. Rep. of Germany . |
| 7708222 | 6/1977 | Fed. Rep. of Germany . |
| 2602191 | 7/1977 | Fed. Rep. of Germany . |

*Primary Examiner*—Philip C. Kannan

*Attorney, Agent, or Firm*—Benasutti and Murray

[57] ABSTRACT

In a swing-tilt fitting for mounting the wing of a window or door to its frame, an arresting means is provided which is operatively associated with the locking rod linkage which controls the operational mode of the wing. Since between every two of the three positions (closure, swinging, tilting) of the operating linkage a lost motion is present, the locking rod linkage can be utilized for actuating the arresting means. Said arresting means can be disposed either laterally between the wing and frame of a window or a door or between tilt shears and members disposed in the upper locking rod channel. The tilt position, which can be stepwise or infinitely variable, is secured by actuating the operating grip of the linkage out of the tilt position into one of the two other positions, closure or swinging. The tilt arrest is effected either by engagement of tooth members or by turning a brake member guided in a hollow rod.

23 Claims, 10 Drawing Figures

SWING-TILT FITTING FOR WINDOW OR DOORS

BACKGROUND OF THE INVENTION

The present invention relates to fittings for mounting the wing of a window or door to its frame and more particularly to swing-tilt fittings for windows and doors which permit the wing of the window or door to be tilted about a bottom axis or swung about a side axis with respect to the frame.

Conventionally, swing-tilt fittings include an operating grip connected to a locking rod linkage concealed in the wing for controlling displacement of the wing with respect to the frame. Such fittings also include tilt shears disposed rotatably on the window or door frame, a corner bearing and at least two locking means disposed on the side of the swing axis and formed by a lock member secured to the linkage and a closure member secured to the window frame. Operation of the grip effects displacement of the concealed locking rod linkage from a first position, wherein the wing is secured in a closed state within the frame, to second and third positions for enabling the wing to be tilted about a bottom axis or to be swung about a side axis with respect to the frame. These positions are not discretely defined in that the grip, and accordingly the locking rod linkage, may be displaced a limited amount without changing the mode of operation of the wing. This limited displacement is sometimes referred to as a lost motion of the locking rods.

Conventionally, the linkage is constructed such that the operating grip is displaceable from a downwardly directed closure position into a horizontally directed tilt position and thereafter into an upwardly directed swing position. It is, however, possible to construct the linkage such that the grip is moved from the downwardly directed closure position through a horizontally directed swing position into an upwardly directed tilt position.

One disadvantage of known swing-tilt fittings is that the wing has only a single tilt position; that is, fully tilted. Generally, the tilt shears are provided to limit the degree of tilt of the wing and thereby define the fully tilted position. However, in most such fittings, a further disadvantage is that the tilt position is not secured so that the window or door wing can unintentionally slam shut.

OBJECTS AND SUMMARY OF THE INVENTION

An object of the present invention is to provide a swing-tilt fitting in which a variety of intermediate positions of a wing can be set between the closed and fully tilted positions.

In particular, it is an object of the present invention to provide a tilt arrest for arresting the wing in intermediate tilt positions between the closed and fully tilted positions.

Further, it is an object of the present invention to provide a tilt arrest which is operatively associated with the concealed linkage and operating grip of the swing tilt fitting.

According to one embodiment, a tilt arrest is disposed on at least one side of the window. The tilt arrest comprises a toothed segment mounted on the displaceable locking rods of the concealed linkage and a toothed counterdog secured to the window frame. Lost motion of the locking rods (either between the closure position and the tilt position or between the swing position and the tilt position) is utilized for actuating the tilt arrest. The lost motion of the locking rods permits the toothed segment on the locking rods to be engaged with (and disengaged from) the toothed counterdog on the window frame when the wing is tilted. Accordingly, it is possible to secure the wing in any of a number of preselected intermediate tilt positions by actuation of the operating grip with the resulting displacement of the locking rods to bring the cooperating arresting members into engagement with each other.

According to a second preferred embodiment of the invention, the tilt arrest is operatively associated with the tilt shears which define the maximum tilt of the wing. A brake member engages the tilt shear linkage to lock it in a desired position. One of the locking rods is operatively associated with the brake so that the tilt motion of the wing is controlled by the operating grip. With the aid of this arresting means it is possible to arrest a window or door wing in an infinitely variable manner in any desired tilt position between closure and maximum tilt.

The invention will be explained hereinafter in detail with the aid of several examples of embodiment with reference to the drawings.

BRIEF DESCRIPTION OF THE DRAWINGS

Referring to FIG. 1, there is shown a swing-tilt window having a wing 10, a window frame 12 and an operating grip 14. In the right upper region of the sash 10 tilt shears 16 are indicated in dashed line. In the closed state, the wing 10 is secured by locking points 18 operated by a concealed locking rod linkage (not shown). Provided at the right lower corner is a track bearing 20. Above the grip 14 is a misoperation safeguard 22 and a lift-out safeguard 24 for preventing the wing from being lifted out of the frame in the tilted condition. The operating grip 14 is illustrated in full line in a downwardly directed closure position. The grip 14 has two other positions, horizontal and vertical (shown in phantom). Operation of the grip from its downward position to one of its other two positions effects displacement of the concealed locking rod linkage to either enable the window wing to be tilted about a bottom axis X—X or to enable the wing to be swung about a side axis Y—Y.

FIG. 2 shows by schematic illustration a window wing in which the operating grip 26 represents the closure position in the downwardly directed position;

the swing position in the horizontal position and the tilt position in the upwardly directed position. The arrow 28 designates a lost motion which can be executed with the operating grip 26 while in the upwardly directed tilt position.

Figure 1:
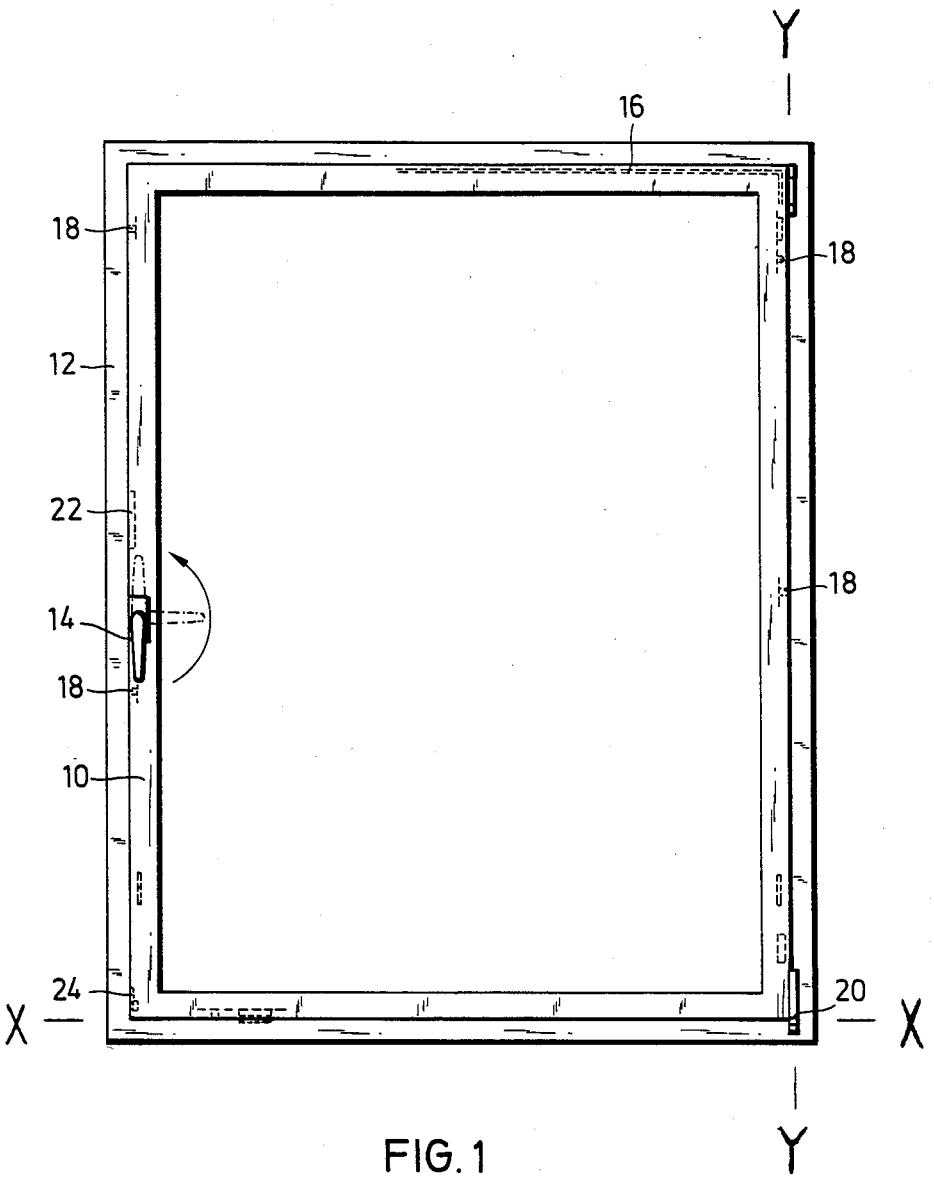
FIG. 1 is a view of a swing-tilt wing of a window or of a door.
Figure 2:
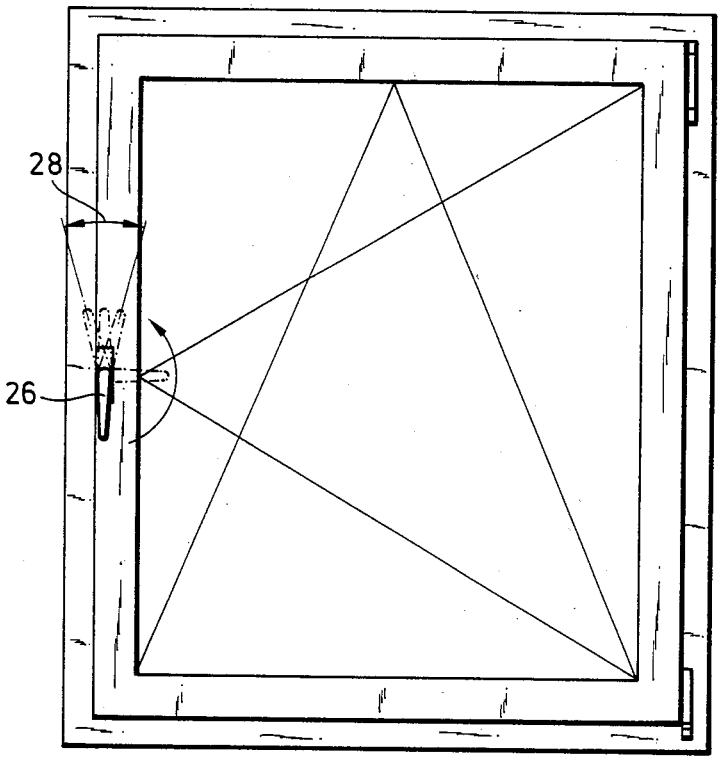
FIG. 2 is a schematic view of a first embodiment of a wing with tilt arrest controlled by the operating grip.
Figure 3:
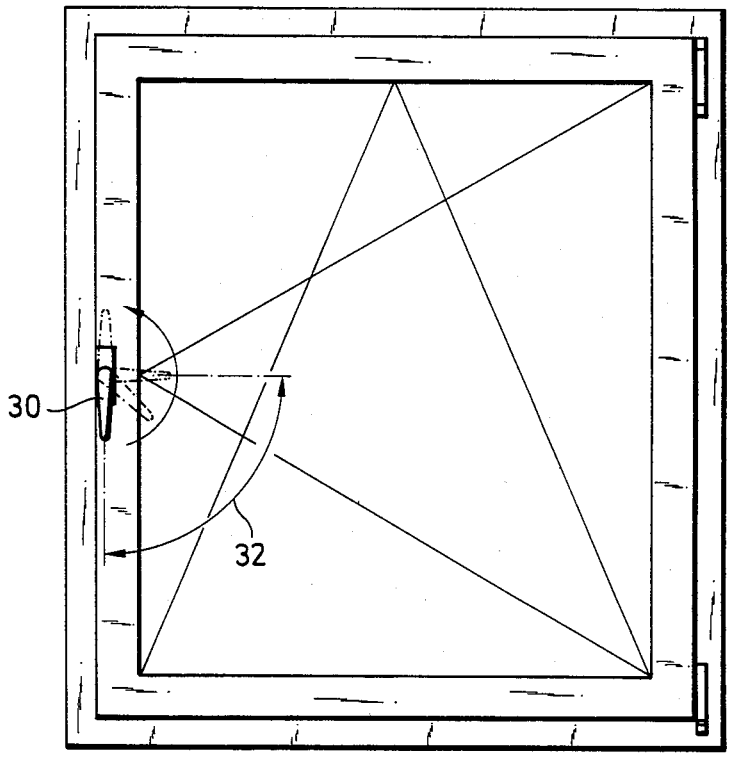
FIG. 3 is a schematic view of a second embodiment of a wing with tilt arrest controlled by an operating grip.

FIG. 3 shows an alternate embodiment of a window in which the concealed linkage is constructed such that the grip 30 is operable from the downwardly directed closure position into a horizontal tilt position and thereafter into an upwardly directed swing position. When the wing is tilted, a lost motion of up to 90 degrees is possible between the closure position and tilt position as indicated by the arrow 32 without changing the operational mode of the wing. The lost motions indicated in FIGS. 2 and 3 are utilized for the actuation of the tilt arrest.

Figure 4:
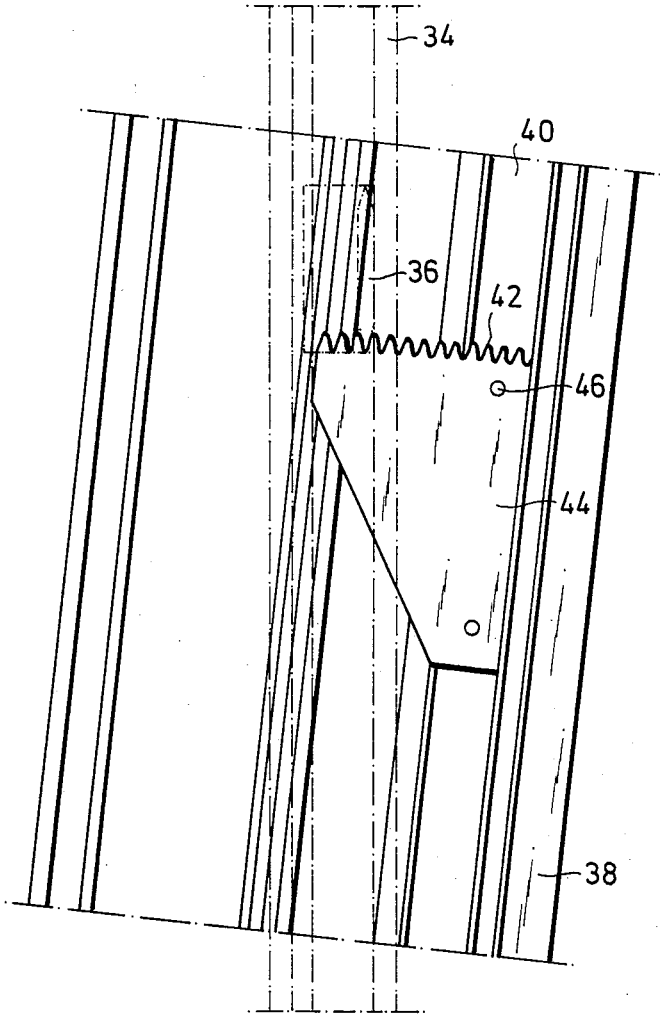
FIG. 4 is a partial side view of a first embodiment of a tilt arrest made in accordance with the toothing of the present invention.

FIG. 4 illustrates a first embodiment of a tilt arrest in accordance with the present invention, with which a window or door wing can be brought into various defined tilt positions and arrested therein. Shown in phantom is a fragment of a window frame 34 on which a counterdog 36 is rigidly mounted. A fragment of a wing 38 is shown in a tilted position within which is disposed a locking rod 40 of the concealed locking rod linkage which is operatively associated with the operating grip. Rigidly secured to the locking rod 40, for example by rivets or screws 46, is a segment 44 provided with teeth 42.

In operation, the operating grip is turned to the tilt position which enables the sash 38 to be tilted with respect to the frame 34 and displaces locking rod 40 such that the toothed segment 44 is positioned slightly below the counterdog 36. When the wing is tilted, the counterdog 36 becomes positioned in the path of the toothed segment 44 such that upward displacement of the locking rod 40 causes the counterdog 36 to engage between two teeth 42 of the segment 44 (as shown).

As discussed above with reference to FIGS. 2 and 3, when the wing is tilted, the operating grip and associated locking rod linkage may be displaced to a limited extent without changing the tilt mode of operation of the wing. Accordingly, this lost motion is utilized to displace the locking rod 40 by a small amount upwardly so that the segment 44 comes into the engagement position with the counterdog 36. Subsequent counter-operation of the operation grip enables the window wing to be brought into a different tilt position after which the locking rod is pulled upwardly again and the counterdog 36 comes into engagement between two of the segment teeth 42.

In the preferred embodiment, the meshing between the counterdog and the toothed segment has a self-locking effect so that no independent unintentional release of these parts can take place. In addition, the parts can be made of wear-resistant material.

The arrangement may be such that the toothing of the segment is directed on the grip-side upwardly or on the hinge-side downwardly. In the case of larger window or door wings it is advisable to provide an arresting means of toothed segment and counterdog on both sides of the wing. Since conventionally opposite locking rods execute a counter-movement, the arrangement of the arresting members is likewise inverted.

With operating grips having sufficient travel reserve, the parts of the tilt arrest, i.e. the counterdog and the segment, can be incorporated without diffficulty into the fittings with conventional grip movements analogous to FIG. 2, in which the horizontal center position denotes the swing movement of the wing. With hand grips with little or no travel reserve it is advantageous to construct the fitting so that the center position of the hand grip corresponds to tilting (FIG. 3). When the wing is tilted, it is thus then possible to fully utilize a 90 degree lost motion to the closed position to operate the tilt arrest.

Figure 5:
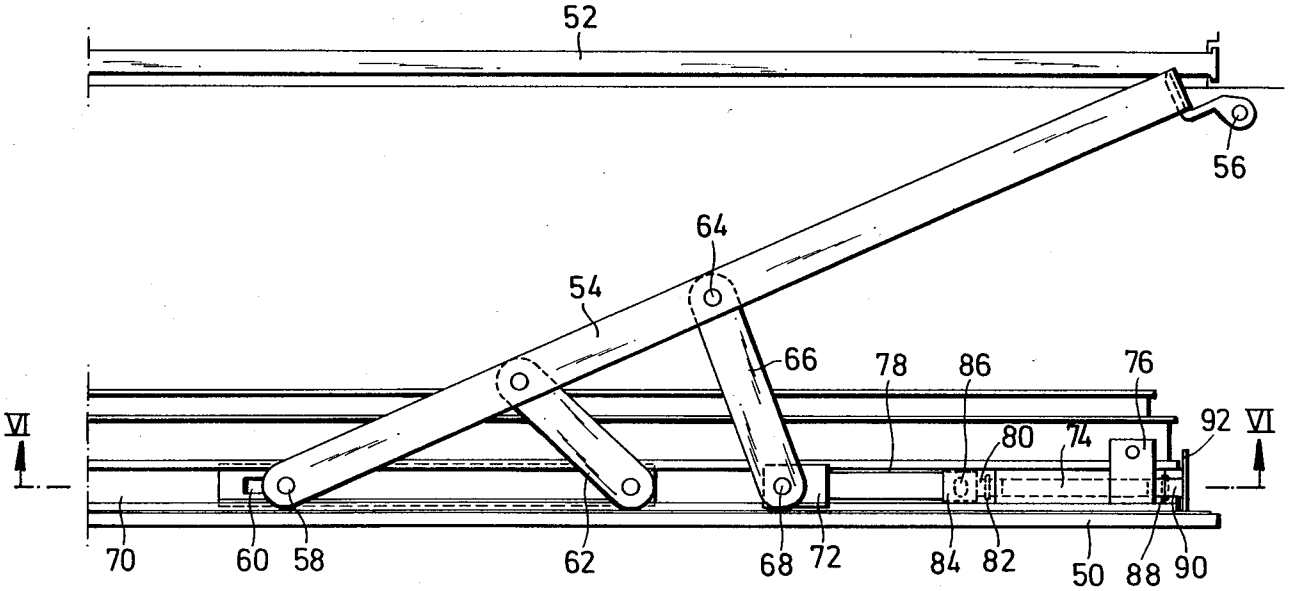
FIG. 5 is a top view of a second embodiment of a tilt arrest made in accordance with the toothing of the present invention.

FIG. 5 illustrates an alternate embodiment of a tilt arrest made in accordance with the teachings of the present invention in which an infinitely variable adjustment of a tilted wing is possible. Tilt shears 54 are disposed between a sash 50 and a window frame 52. At one end the tilt shears 54 are articulately connected via a linkage 56 to the window frame 52 and at their other end to a pin 58 which is guided in a slot 60 in the locking channel of the wing 50. A cross link 62 limits the displacement of the tilt shears in the maximum tilt position of the wing.

Rotatably secured to the tilt shears 54 via a pin 64 is a second cross link 66. At its other end the cross link 66 is rotatably connected via a pin 68 to a hollow locking rod 72 running in the window rabbet or groove 70. Engaging in said hollow locking rod 72 is an end of a round torsion bar 74. The torsion bar 74 is mounted by a clip 76 rotatably in the locking rod channel 78 of the sash 50. Disposed at the end of the torsion bar 74 projecting into the hollow locking rod 72 is a brake member 80 which is held by a pin 82 on the torsion bar 74. Disposed round the torsion bar 74 is a ring 84 comprising a pin 86 which projects into the wall of the locking rod channel bottom and which prevents a longitudinal displacement of the torsion bar 74 in the locking rod channel. On the right end of the torsion bar 74, a pin 90 with square extension is secured via a pin 88. Riveted to that square extension is a plate 92.

Figure 6:
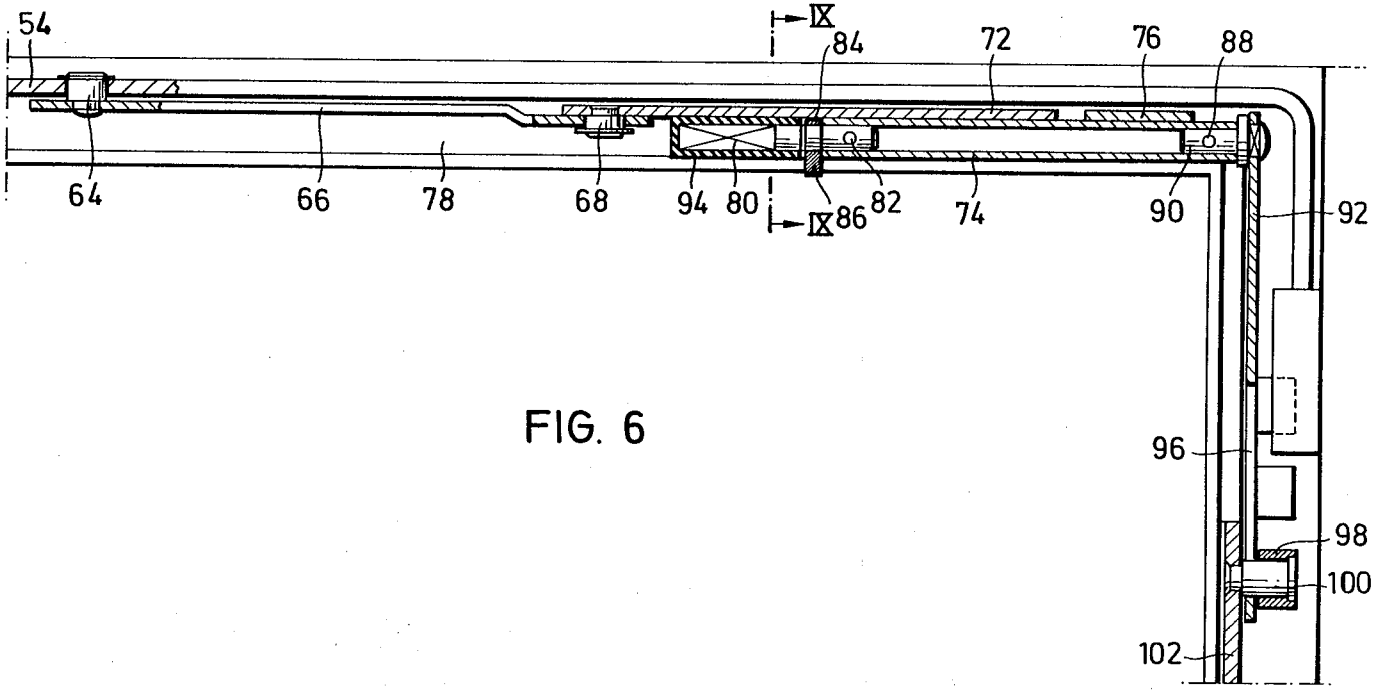
FIG. 6 is a section along the line VI—VI of FIG. 5.

FIG. 6 shows a section through the wing. The torsion bar 74 held by the clip 76 can be seen in the locking rod channel 78. The torsion bar 74 is constructed as tube and comprises at its left end the brake member 80 which is guided in the interior of the hollow locking rod 72. To achieve a good friction action at the inner walls of the hollow locking rod 72 the brake 80 is coated with rubber 94. The tolerances between the rubber-coated brake member 80 and the hollow chamber of the locking rod 72 are matched so that the hollow rod 72 can easily be displaced beyond the brake member. As can be seen from FIG. 6 the pin 86 disposed on the ring 84 is guided in the locking rod channel bottom.

The control plate 92 riveted to the other end of the torsion bar 74 extends perpendicularly to the torsion bar and is arranged running downwardly laterally parallel to the sash. Provided in the control plate 92 is a curved slot 96 in which is guided a pin 100 which is provided with a roller 98 and is secured to the upper end of a locking rod 102 of the control linkage which is operatively associated with the operating grip.

Figure 7:
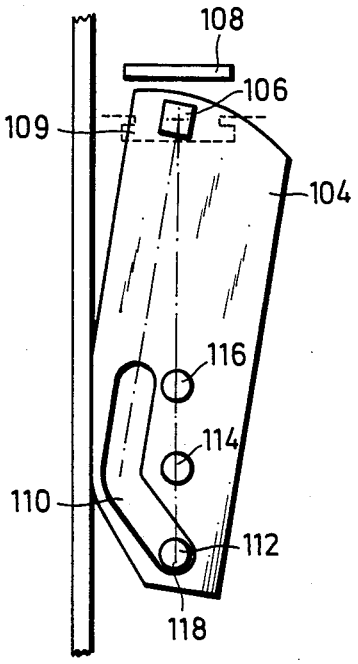
FIGS. 7 and 8 are embodiments of control plates.
Figure 8:
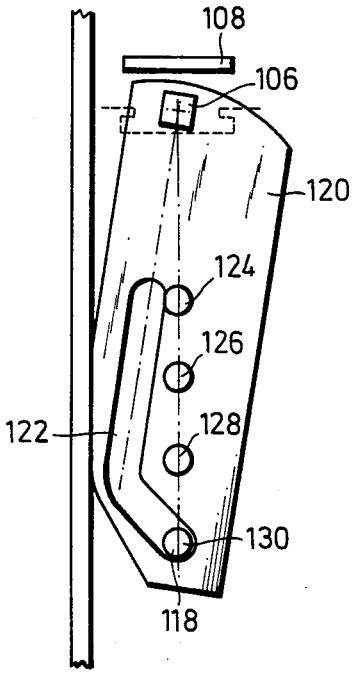

FIGS. 7 and 8 show two embodiments of control plates. The control plate 104 shown in FIG. 7 is intended for a swing-tilt fitting in which the center position of the operating grip corresponds to tilting. The control plate 104 is secured at its upper end to the square extension 106 on the torsion bar. Indicated thereabove are tilt shears 108 and in dashed lines a locking rod channel 109. In the lower region the control plate 104 is provided with a slot 110, which has substantially the form of a boomerang.

Positions 112, 114 and 116 schematically denote possible positions of the upper end 118, provided with a pin and a roller, of the locking rod. The lower position 112 corresponds to the closure position of the wing, the position 114 to the tilt position and the position 116 to the swing position. Between the position 112 and the position 114 the braking stroke or lost motion is carried out by the operating grip. When the end 118 is disposed in the position 112 the control plate 104 is pivoted, the torsion bar twisted and the brake member thus clamped in the hollow locking rod. During the actuation of the grip from the closure position to the tilt position the control plate 104 is displaced to the right so that the torsion bar is moved to its untwisted initial position. When the end 118 has assumed the position 114 the wing can be tilted. If the grip is now moved in the closure position direction again, the end 118 slides downwardly in the slot 110 and the control plate 104 is again pivoted to the left. This however involves another twisting of the torsion bar so that the brake member is again tilted with a braking action in the hollow locking rod. If another tilt position is to be assumed the operating grip must be actuated again in the tilt position direction, whereupon the wing is brought into the desired position, whereupon the operating grip is thereafter moved again into the closure position. At the transition from the tilt to the swing position the slot 110 extends with its upper region substantially perpendicular so that no twisting of the torsion bar takes place.

The control plate 120 shown in FIG. 8 is intended for a swing-tilt fitting in which the center position of the operating grip corresponds to the swinging (cf. FIG. 2). In this case, a slot 122 is formed in the control plate 120 which has a longer upper region. In the closure position, the end 118 of the locking rod is in an upper position 124, for swinging the wing it is in a swing position 126 there below and for tilting in a tilt position 128. To arrest a wing in any desired tilted position the operating grip is pivoted so that the locking rod is led with its end 118 downwardly, the control plate 120 thereby being pivoted to the left so that the torsion bar is twisted and the brake member tilted in the hollow locking rod. This brake position is designated by 130 at the lower end of the slot 122.

The arresting operation of a wing in the tilt position is thus thereby achieved in that the wing is brought into a tilt gap ventilating position, whereupon the lost motion at the operating grip is executed so that the wing is retarded before closing or opening impact. By the actuation of the operating grip in the lost motion, via the linkage, the pin 118, the curve-like slot 110 or 122, the control plate 104 or 120 with the torsion bar 74 and the brake member 80 is rotated through about 10 degrees so that the brake member is clamped in the hollow space of the locking rod 72. When the wing is tilted the hollow locking rod 72 is displaced via the tilt shears 54 and the cross links 66. This is, however, not possible when the locking rod 72 is held by the clamped brake member.

Figure 9:
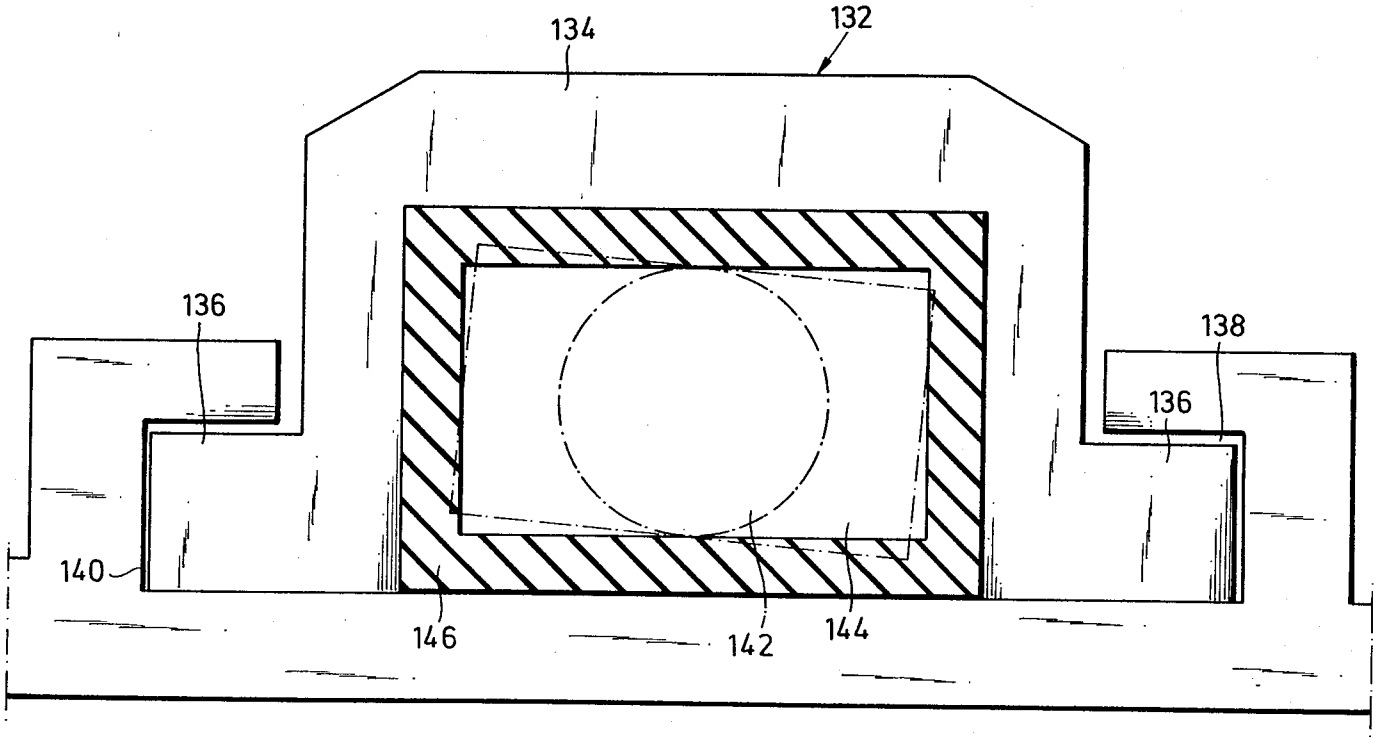
FIG. 9 is a section through a brake member along the lines IX—IX of FIG. 6.

FIG. 9 shows a first embodiment of a locking rod with brake member guided therein. The locking rod 132 is U-shaped in cross-section and constructed with outwardly directed leg ends 136 parallel to the center web 134. Said leg ends 136 engage behind undercuts 138 which are provided in the locking rod channel 140. In the interior the hollow locking rod 132 has a free rectangular cross-section. Secured to a torsion bar 142 is a brake member 144 which is rectangular in cross-section and is provided with a rubber covering 146 likewise of rectangular cross-section. The outer cross-section of the rubber covering 146 corresponds to the inner free cross-section of the locking rod 132. When the torsion bar 142 is twisted the rubber covering 146 is pressed against the inner wall of the hollow locking rod 132 so that a braking action occurs between the braking member and the hollow locking rod.

Figure 10:
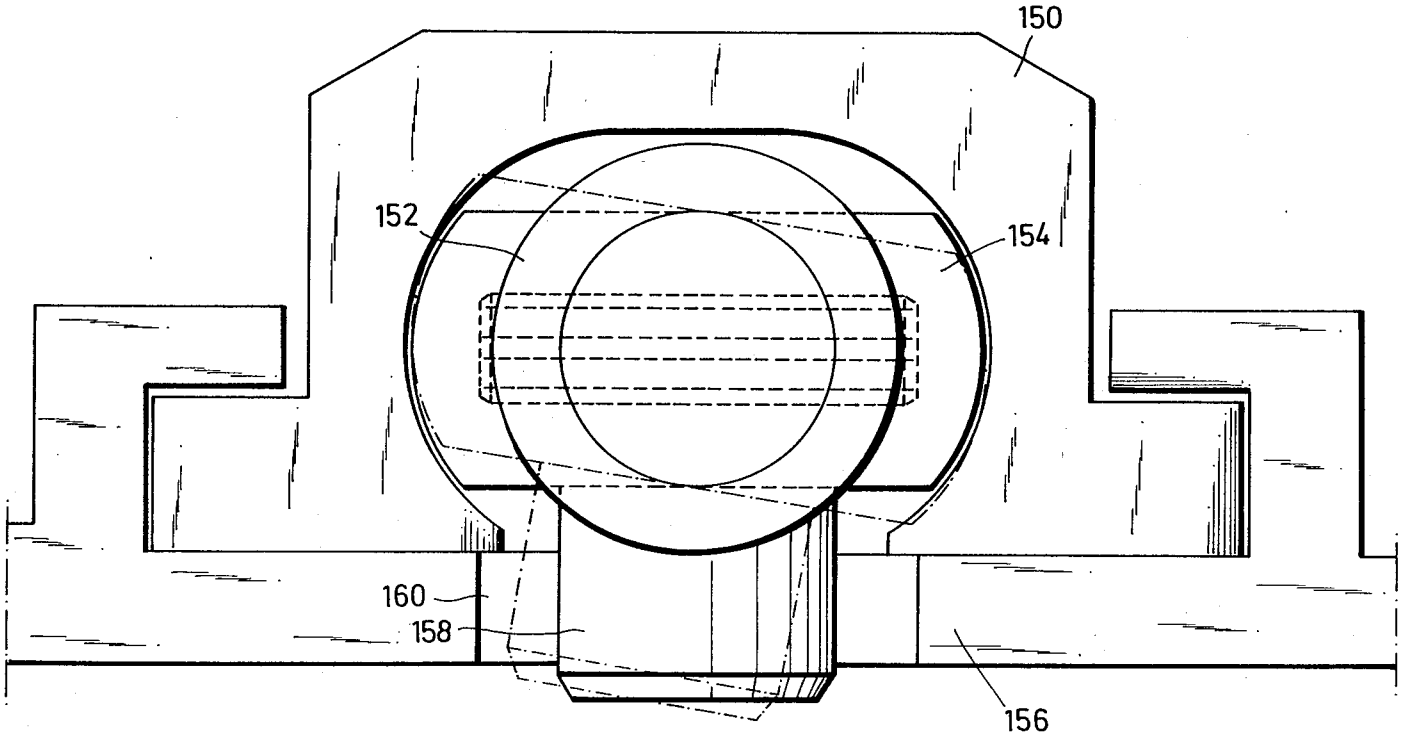
FIG. 10 is a section through another embodiment of a brake member.

FIG. 10 shows another embodiment of a brake member. A hollow locking rod 150 comprises an outer cross-section corresponding to the hollow locking rod 132. The inner free cross-section of the locking rod 150 consists of two semi-circles between which a rectangular center portion is provided. Rigidly secured to a torsion bar 152 is an elongated brake member 154 whose end faces are made in the form of circular arcs whose radius corresponds to the radius of the semi-circles of the inner cross-section of the locking rod 150. When the torsion bar 152 is twisted the brake member 154 is also twisted which then acts within the locking rod 150 as an eccentric and produces a clamping between the brake member and locking rod. Disposed on the brake member 154 is a downwardly projecting pin extension 158 led in the wall of the locking rod channel 156, said pin extension 158 preventing a longitudinal displacement of the torsion bar 154 in the locking rod channel. The pin extension 158 is led in a transversely extending slot 160 which permits the tumbling movement of the pin extension.

What I claim is:

1. In a Swing-tilt fitting for windows or the like for enabling a wing to be tilted about a first axis or swung about a second axis with respect to a frame comprising a grip operatively associated with a linkage concealed in the wing having a three position mechanism including locking rods, tilt shears disposed rotatably on the window frame, a corner bearing, and at least two locking means disposed on the side of the swing axis of rotation and formed by a lock member secured to the linkage and a closure member secured to the window frame, an improvement comprising:

tilt arrest means operatively associated with said locking rod linkage for arresting the wing in various tilt positions.

2. Swing-tilt fitting according to claim 1 wherein said tilt arrest means is disposed on one side of the window on the locking rods and the frame.

3. Swing-tilt fitting according to claim 2, wherein:

said tilt arrest means comprises a toothed segment mounted on the displaceable locking rods of the wing; and a toothed counterdog secured to the frame; and a lost motion of the locking rods is executable with the operating grip, when the wing is tilted, to effect toothing engagement and disengagement of said segment and counterdog.

4. Swing-tilt fitting according to claim 3 wherein the toothing of said segment is directed upwardly on the side opposite the swing axis.

5. Swing-tilt fitting according to claim 3 wherein meshing toothing of said segment and counterdog is made self-locking.

6. Swing-tilt fitting according to claim 1 wherein said tilt arrest means is operatively associated with the tilt shears.

7. Swing-tilt fitting according to claim 6 wherein said tilt arrest means comprises a cross link having one end rotatably secured to the tilt shears; the other end of said cross link rotatably articulately connected to a hollow rod disposed for slidable displacement within a channel defined in the window wing; a brake member disposed within said hollow rod and secured to one end of a torsion bar for selected braking engagement with the interior of said hollow rod; a control plate with a curved slot non-rotatably secured to the end of the torsion bar opposite said brake member; and slot engaging means affixed to one of the locking rods and displaceable within said slot such that selected operation of the operating grip, when the wing is tilted, displaces said slot engaging means within said slot effecting pivotal movement of said control plate thereby effecting engagement and release of the brake member within said hollow rod for arresting the tilt of the wing.

8. Swing-tilt fitting according to claim 7, wherein the torsion bar is a tube and is twistable through about 10 degrees.

9. Swing-tilt fitting according to claim 7 wherein the brake member is coated with rubber.

10. Swing-tilt fitting according to claim 7 wherein the torsion bar is held non-displaceably in the longitudinal direction by a pin engaging in a transverse slot defined in the hollow rod channel.

11. Swing-tilt fitting according to claim 7 wherein said slot engaging means affixed to said locking rod comprises a pin provided with a roller.

12. Swing-tilt fitting according to claim 7 wherein the hollow rod is U-shaped in cross-section with outwardly directed leg ends and the hollow rod channel defined in the window wing is selectively configured for engagement with said leg ends.

13. Swing-tilt fitting according to claim 12 wherein the hollow rod has an inner free rectangular cross-section and that said brake member is rectangular in cross-section.

14. Swing-tilt fitting according to claim 7 wherein the hollow rod has an inner free cross-section comprising two semi-circles with intermediate rectangular center portion and that the brake member is provided with correspondingly rounded end faces.

15. Swing-tilt fitting according to claim 14 wherein a downwardly projecting pin extension is provided on the brake member which is guided in a transversely extending slot formed in the hollow rod channel.

16. Swing-tilt fitting for mounting a wing member in a frame comprising:

a. an operating grip for effecting displacement of a locking rod linkage mounted on said wing, between a closure position for securing said wing in a closed position in said frame;

a tilt position for enabling said wing to be tilted about a first axis with respect to said frame; and a swing position for enabling said wing to be swung about a second axis with respect to said frame, said second axis being substantially perpendicular to said first axis;

said locking rod linkage selectively displaceable from said tilt position when said wing is tilted with respect to said frame, via operating of said operating grip;

b. tilt arrest means for securing said wing in multiple tilt positions with respect to said frame; and c. said selective displacement of said locking rod linkage from said tilt position effective to operate said tilt arrest.

17. Swing-tilt fitting according to claim 16 wherein said tilt arrest means comprises:

a toothed segment secured to one of said locking rod linkage;

a counterdog mounted on one side of said frame; and said toothed segment operatively associatable with said counterdog when said wing is tilted via said selected displacement of said locking rod linkage from tilt position whereby said wing is securable at any of a number of discreet intermediate tilt positions corresponding to the teeth of said toothed segment.

18. Swing-tilt fitting according to claim 17 wherein said swing position of said locking rod linkage is between said closure position and said tilt position.

19. Swing-tilt fitting according to claim 18 wherein said first axis is substantially horizontal and said second axis is substantially vertical.

20. Swing-tilt fitting according to claim 16 further comprising:

tilt shears for limiting the tilt of said wing with respect to said frame thereby defining maximum tilt position; and said tilt arrest means being operatively associated with said tilt shears such that said wing is securable in any intermediate tilt position between said maximum tilt position and closure.

21. Swing-tilt fitting according to claim 20 wherein said tilt arrest means comprises:

a hollow rod mounted on said wing such that displacement of said tilt shears, when said wing is tilted, effects lateral displacement of said hollow rod;

a rotatable brake member disposed within said hollow rod for arresting displacement of said hollow rod; and control plate means operatively associated with said locking rod linkage for effecting operation of said brake member when said wing is tilted via said selected displacement of said locking rod linkage from said tilt position thereby arresting displacement of said hollow rod and accordingly arresting displacement of said wing in a selected tilt position.

22. Swing-tilt fitting according to claim 20 where said swing position of said locking rod linkage is between said first closure position and said second tilt position.

23. Swing-tilt fitting according to claim 22 wherein said first axis is substantially horizontal and said second axis is substantially vertical.

* * * * *